US006243038B1

(12) United States Patent
Butler et al.

(10) Patent No.: US 6,243,038 B1
(45) Date of Patent: Jun. 5, 2001

(54) SYSTEM AND METHOD PROVIDING AMPLIFICATION OF NARROW BAND SIGNALS WITH MULTI-CHANNEL AMPLIFIERS

(75) Inventors: Ray K. Butler, Woodinville; Richard H. Chesarek, Seattle, both of WA (US); Richard D. Posner, Woodland Hills, CA (US)

(73) Assignees: Metawave Communications Corporation, Redmond, WA (US); Powerwave Technologies, Inc., Irvine, CA (US)

( * ) Notice: Subject to any disclaimer, the term of this patent is extended or adjusted under 35 U.S.C. 154(b) by 0 days.

(21) Appl. No.: 09/213,980

(22) Filed: Dec. 17, 1998

(51) Int. Cl.[7] ..... H01Q 3/22; H01Q 3/24; H01Q 3/26

(52) U.S. Cl. ..... 342/373; 330/124 R

(58) Field of Search ..... 342/373; 330/124 R

(56) References Cited

U.S. PATENT DOCUMENTS 4,885,551 12/1989 Myer ..... 330/52
4,901,085 * 2/1990 Spring et al. ..... 342/373
4,907,004 * 3/1990 Zacharatos et al. ..... 342/373
5,023,565 6/1991 Lieu ..... 330/151
5,304,945 4/1994 Myer ..... 330/149
5,604,462 * 2/1997 Gans et al. ..... 330/124 R
5,648,784 * 7/1997 Ruiz et al. ..... 342/373
5,764,104 * 6/1998 Luz ..... 330/124 R
5,825,762 * 10/1998 Kamin et al. ..... 370/335
5,847,603 12/1998 Myer ..... 330/52
5,917,371 * 6/1999 Chesarek et al. ..... 330/124 R
6,006,111 * 12/1999 Rowland ..... 455/561

* cited by examiner

*Primary Examiner*—Theodore M. Blum
(74) *Attorney, Agent, or Firm*—Fulbright & Jaworski L.L.P.

(57) ABSTRACT

Systems and methods are taught whereby amplification of narrowband signals may be accomplished by linear power amplifiers requiring the presence of a communicated broadband signal in order to make internal adjustments necessary for linear operation. A preferred embodiment is described utilizing an input of a distributed amplifier assembly unused by the signals of interest in order to inject an emulated CDMA tone operable as a pilot tone for use by the linear power amplifiers.

45 Claims, 3 Drawing Sheets

SYSTEM AND METHOD PROVIDING AMPLIFICATION OF NARROW BAND SIGNALS WITH MULTI-CHANNEL AMPLIFIERS

BACKGROUND OF THE INVENTION

It is common to utilize radio frequency (RF) signals, having particular characteristics, in conducting information communication such as voice and data communication. For example, wireless communications, including cellular, global system for mobile (GSM) and personal communication services (PCS), utilize RF signals of predefined frequencies of particular bandwidths, in order to transmit information between two communication nodes.

Multiple schemes have been developed to conduct a plurality of simultaneous communications without substantial interference there between. For example, frequency division has been utilized to divide available spectrum into channels assignable to particular ones of the communication nodes in order to provide for their intercommunication, such as is used in the Advance Mobile Phone Service (AMPS) and narrowband AMPS (N-AMPS). Likewise, code division multiple access (CDMA) has been utilized, such as provided for in Interim Standard 95 (IS-95), to assign chip codes to particular ones of the communication nodes in order to provide for their intercommunication over a broadband carrier simultaneously utilized by other ones of the communication nodes. Similarly, time division multiple access (TDMA) schemes have been utilized, such as provided for under the United States Digital Cellular System (USDC) standard IS-54, to distribute time bursts of available communication capacity among communication nodes. Additionally, in establishing a wireless communication infrastructure providing for multiple service providers, portions of available spectrum in the United States have been established to allow provision of wireless communication services, regardless of the particular scheme utilized for providing the communications, i.e., "A band" service provider and "B band" service provider in the same geographic area.

In providing the above described communications, it is often necessary to manipulate signals as they pass through, or are otherwise handled by, the communication system in order that they may be utilized in a desired manner. Typically in wireless communication systems, as well as other systems, signal amplification is necessary in order to provide a signal which exhibits proper characteristics, such as is provided to a receiving communication node with a desired signal magnitude or signal to noise (S/N) ratio. However, in order to provide a desired amplified signal without introducing distortion or other undesired characteristics it is often necessary to utilize costly equipment such as linear power amplifiers (LPA). Moreover, as such communications may include multiple nodes operating within a same area, although upon different assigned channels i.e., multiple subscriber units operating within a single sector of a cellular communication system cell, signal amplification associated with a particular antenna, or other common signal path, must provide linearity throughout a wide range of frequencies, further necessitating the use of costly equipment.

Accordingly, solutions in the past have included the disposing of various forms of LPAs in the signal paths of RF communication signals. For example, feed forward LPA amplifier technology has been utilized, although such technology is relatively expensive as typical feed-forward LPAs use internally generated pilot tones to assist in the adjustment of internal settings necessary for the linearization of multiple carrier or complex waveform signals. Moreover, where multiple LPAs are required, such as in a distributed amplifier configuration or where multiple antenna beams each have associated therewith a LPA, the replication of the above internal circuitry, and therefore its added expense, is required for each amplifier.

Therefore, a need exists in the art for a system and method for providing a signal in a desired condition without introducing distortion or other undesired characteristics through its manipulation. There is a further need in the art for the provision of the signal in a desired condition through the use of less complicated and less costly equipment. Moreover, there is a need in the art for providing such signals in the desired condition irrespective of the scheme, or schemes, utilized to allow multiple simultaneous communications.

SUMMARY OF THE INVENTION

These and other objects, features and technical advantages are achieved by a system and method which utilizes an externally generated signal or pilot signal, preferably in the form of an emulated CDMA (IS-95) carrier, injected at a pre-defined frequency into the signal path prior to the LPA, or LPAs, utilized to provide amplification. Accordingly, LPAs which do not include circuitry for generation, injection, and removal of an internal pilot signal, as well as their added expense and complexity, may be utilized in the provision of signals having a desired condition.

Preferably, the frequency of the emulated CDMA carrier is near that of RF signals of interest to be manipulated according to the present invention in order that the linearity of amplification of these signals of interest may be accurately controlled through use of the emulated pilot signal. For example, in a preferred embodiment, where the manipulated signals are cellular telephone communications, the frequency of the CDMA carrier is within the 25 MHZ cellular base transceiver station (BTS) transmit band, although not within the operator's licensed band. Alternatively, the frequency of the CDMA carrier is selected to be outside both the BTS transmit band and the operator's licensed band, i.e., where a BTS is operated within a cellular A band, the emulated CDMA carrier is within the cellular B band.

According to the present invention, use may be made of amplifiers having substantially less circuitry, and therefore expense, in order to provide signals having a desired magnitude. For example, multi-channel amplifiers (MCA) such as model NTGS 86A8, available from Powerwave Technologies, Inc., 2026 McGaw Avenue, Irvine, Calif. 92614, which provide linear power amplification through the use of digital signal processing (DSP) and the presence of a communicated CDMA signal as the basis of optimizing the MCA parameters.

A preferred embodiment of the present invention utilizes a plurality of amplifiers in a matrix in order to provide distributed amplification of signals of interest. As such, any signal provided at an input of the matrix will appear at each of the amplifiers. Accordingly, this embodiment of the present invention may further reduce the circuitry and costs involved by introducing the emulated pilot signal at a single input of the distributed amplifier matrix while still providing the pilot signal necessary for proper amplification of the signals of interest.

It is a technical advantage of the present invention that manipulation of signals of interest to provide a desired characteristic may be accomplished utilizing less expensive and less complicated circuitry than required in the prior art. Furthermore, a technical advantage is realized through the use of circuitry adapted for use with broadband signals, such as CDMA carriers, in providing manipulation of signals of interest although communicated utilizing narrowband channels or otherwise non-compatible signals.

A still further technical advantage is realized according to the present invention as the speed of adjustments necessary for desired operation of the amplifiers may be improved as the frequencies of the emulated pilot signal are pre-selected, and therefore known, and thus the circuitry would not be required to acquire the frequency, as it is known a priori.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE INVENTION

In understanding the concepts of the present invention reference shall be made to an example of its use in a cellular communication system. However, it should be appreciated that the present invention is not limited to such communication systems nor the preferred embodiments described herein with respect thereto.

Figure 1:
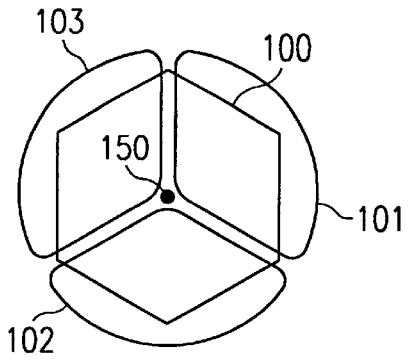
FIG. 1 shows a typical three sectored communication cell.
Figure 2:
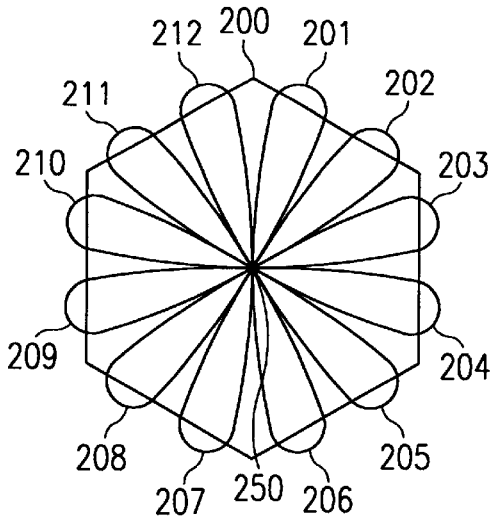
FIG. 2 shows a multiple narrow beam communication cell.

Directing attention to FIG. 1, a typical three sectored cell of a cellular communication system is illustrated. as cell 100 having sector patterns 101, 102, and 103 associated with an $\alpha$, $\beta$, and $\gamma$ sector respectively. Accordingly, BTS 150 may establish and maintain communication with communication nodes, such as mobile subscriber units (not shown), operating throughout the area of cell 100. Similarly, shown in FIG. 2 is cell 200 having multiple narrow antenna beams utilized therewith. Specifically, cell 200 has narrow antenna beam patterns 201–212 radiated from BTS 250 is shown.

Signals communicated within each of antenna patterns 101–103 of FIG. 1 and 201–212 of FIG. 2 generally require manipulation, such as in the way of amplification, filtering, combining, etcetera, in order to conduct the desired cellular communications. Accordingly, the circuitry of BTSs 150 and 250 includes circuitry disposed in the signal path of the signals communicated within the antenna patterns.

Figure 3:
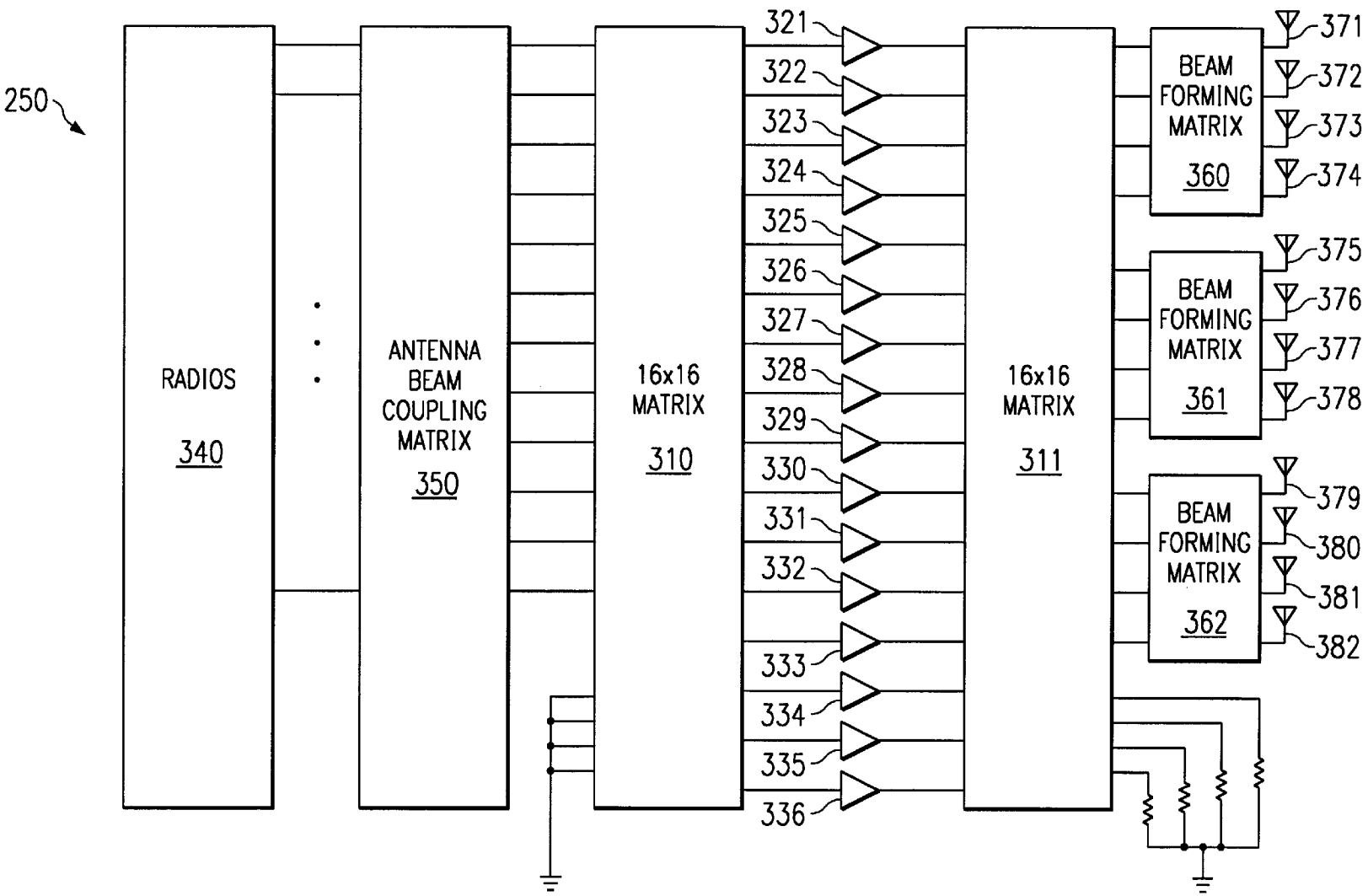
FIG. 3 shows circuitry adapted to communicate signals within the multiple narrow beams of FIG. 2.

Directing attention to FIG. 3, circuitry of BTS 250 such as is useful in providing communications within the multiple narrow beams of FIG. 2 is shown. Here radios 340 communicate signals to remote communication nodes through antennas 371–382 of BTS 250. Radios 340 may, for example, provide and/or receive signals, modulated within a preselected channel, associated with a particular communication node at a particular interface coupled to antenna beam coupling matrix 350. Coupling matrix 350 provides coupling of particular communication node signal streams to circuitry of BTS 250 associated with an antenna beam or radiation pattern within which the communication node is operating. Accordingly, a signal appearing at a first interface port of radios 340 may be coupled to a particular antenna or antennas of 371–382 through signal paths established within coupling matrix 350.

In order to provide signals having a desired attribute, amplifiers 321–336 are disposed in the signal paths between the radios and the antennas utilized in forming the antenna beams. In the embodiment of FIG. 3, amplification of signals of interest is provided by a distributed amplifier arrangement utilizing matrices 310 and 311 in combination with amplifiers 321–336, which in the preferred embodiment are LPAs. Of course, non-distributed amplification, i.e., direct one-to-one amplification of signals, may be utilized in communicating signals having a desired attribute. Moreover, although illustrated and described herein below as being in the forward signal path, it shall be appreciated that signals communicated according to the circuitry of FIG. 3 may be communicated in the reverse signal path as well by the well known expedient of reversing the active circuitry such as direction of the amplification circuitry.

In operation, matrix 310, shown as a 16×16 matrix which may be a Butler or hybrid matrix, distributes any signal appearing at its inputs across all the amplifiers 321–336 coupled to the outputs of matrix 310. For example, a signal provided to a first input of matrix 310 will be distributed as signal components to each of amplifiers 321–336. After amplification by amplifiers 321–336, the amplified signal components are provided to inputs of matrix 311, also shown as a 16×16 matrix, providing signal paths inverse to those of matrix 310. Matrix 311 recombines the signal components to form an amplified version of the original signal. In our above example, matrix 311 provides an amplified version of the input signal at an output of matrix 311 corresponding to the input of matrix 310 having a gain factor of distributed amplifiers, 321–336.

The antenna beam signals, as distributed by matrix 310, amplified by amplifiers 321–336, and recombined by matrix 311, are provided to beam forming matrices 360–362, which may be Butler matrices for example, for radiation by antennas 371–383. In the embodiment illustrated in FIG. 3, beam forming matrices 360–362 accept a signal associated with a particular antenna beam, such as illustrated in FIG. 2, at each input and provide this signal having a selected phase and/or amplitude progression at a plurality of its outputs. Accordingly, the energy radiated by the antennas coupled to the beam forming matrices constructively and destructively combines to result in the desired radiation pattern.

In addition to the circuitry shown in FIG. 3, circuitry may be included, such as filters, amplifiers, duplexers, frequency converters, useful in providing desired signals between antennas 371–382 and radios 340. For example, duplexer circuitry may be disposed in the signal path near antennas 271–382 in order to provide for their use in both the forward and reverse links. Additionally, low noise amplifiers and/or filters may be provided in the signal path near antennas 371–382, such as might be included in the aforementioned duplexer circuitry, in order to improve signals communicated there through such as by providing out of band rejection or improved signal to noise ratio.

It shall be appreciated that typical signal feed network matrices, such as the aforementioned matrix, provide inputs and outputs numbering in a power of two (i.e., $2^n$). Accordingly, matrices 310 and 311, although providing sixteen inputs and outputs, are selected for use with the system of FIG. 3, although only twelve discrete antenna beam signals are utilized. Accordingly, four inputs of matrix 310 and four outputs of matrix 311 are unused in the system of FIG. 3 and are, therefore, terminated.

The circuitry of FIG. 3 provides for the distributed amplification of any input signal (i.e., a signal input at any single input signal path is distributed across a number of LPAs). As such, the arrangement provides advantages of distributed amplification, such as amplifier operation in a more linear range, load sharing, as well as fault tolerance for an inoperative LPA. However, amplifiers, especially LPAs, are often very expensive and, therefore, it is desirable to deploy cost effective amplifiers while maintaining desired signal quality.

Accordingly, it is desirable to utilize amplifiers which are simplified and less expensive, such as feed forward amplifiers with reduced internal circuitry in order to assist in the adjustment of internal settings necessary for the linearization of signals to be amplified. Therefore, amplifiers 321–336 may be LPAs which utilize an external signal, such as the signal to be amplified itself, to make internal adjustments to achieve linearity as signals are amplified.

LPAs in the form of multi-channel amplifiers (MCA) such as model NTGS 86A8 available from Powerwave Technologies, Inc., 2026 McGaw Avenue, Irvine, Calif. 92614, provide linear power amplification through the use of digital signal processing (DSP) and the presence of a communicated CDMA signal as the basis of optimizing the MCA parameters. Accordingly, amplifiers 321–336 of FIG. 3 might consist of these MCAs where radios 340 communicate a CDMA signal. However, where radios 340 do not communicate a broadband signal, such as in an AMPS only BTS, utilizing the aforementioned MCAs as amplifiers 321–336 would not provide the desired results.

Figure 4:
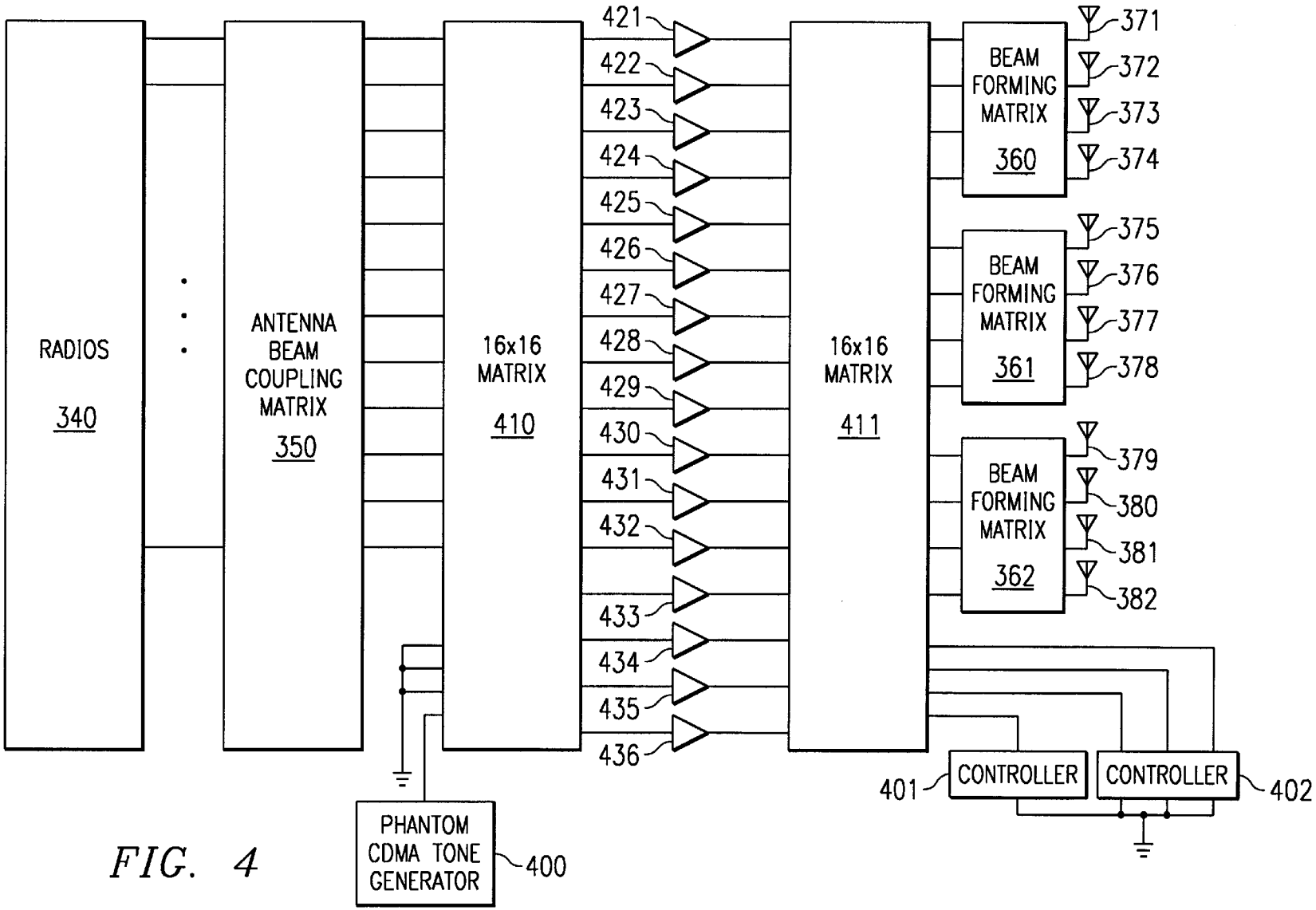
FIG. 4 shows circuitry adapted according to a preferred embodiment of the present invention to communicate signals within the multiple narrow beams of FIG. 2.

Directing attention to FIG. 4, the circuitry of FIG. 3 adapted according to a preferred embodiment of the present invention may be seen. In the embodiment of FIG. 4, one input of matrix 410, not necessary for coupling the antenna beam signals between the antenna beam coupling matrix 350 and antennas 371–382, is utilized for coupling to phantom CDMA tone generator 400, rather than being terminated as in FIG. 3. In the preferred embodiment generator 400 includes an RF oscillator or oscillators, wideband amplifier, and output attenuator as are well known in the art for use in signal generation. Preferably, this generator produces a broadband signal similar to an IS-95 signal.

As described above, any signal provided by generator 400 at the input of matrix 410 will appear at each of the outputs of matrix 410 and, therefore, at each of amplifiers 421–436. Where amplifiers 421–436 require a particular signal for operation which is not present in the signals communicated by radios 340, generator 400 may be utilized to generate such a signal and provide it to each of the amplifiers concurrently with the signals of interest.

For example, where amplifiers 421–436 are the above mentioned MCAs, as in the preferred embodiment, generator 400 may generate a broadband signal having a rectangular, relatively controlled, spectral shape, preferably in the form of an emulated CDMA IS-95 carrier. Accordingly, non-CDMA signals, such as AMPS or N-AMPS cellular communications, may be communicated by the system utilizing cost effective MCAs in the distributed amplifier arrangement.

Preferably, the signal generated by generator 400 is selected so as to correspond to a signal of sufficient output level at each of the amplifiers so as to provide a signal sufficient to function as a pilot for the amplifiers as well as to be of a sufficiently low magnitude not to unacceptably interfere with the signals desired to be transmitted.

In the preferred embodiment, matrices 410 and 411 are the aforementioned hybrid matrices. Hybrid matrices utilize relatively inexpensive hybrid splitters and are desirable as the input signal is provided to each of the matrix's outputs as component signals having a phase difference equal to that of the hybrid splitter as between adjacent signal components. Accordingly, hybrid matrices provide a relatively inexpensive method of providing the full spectrum of the generated signal to each amplifier.

Alternatively, matrices 410 and 411 are the aforementioned Butler matrices. Butler matrices provide the input signal to each of the matrix's outputs as spectral components, i.e., effectively provides a Fourier transform of the inputs signal, for amplification by each of the amplifiers. Accordingly, components of the broadband signal introduced at any input of the Butler matrix will appear at each matrix output for use according to the present invention.

It shall be appreciated that the port to port isolation of the distributed amplifier assembly of FIG. 4 will result in signals input at a particular input of matrix 410 appearing substantially only at a corresponding output of matrix 411. Accordingly, the signal injected into the circuitry by generator 400 will be substantially isolated from the signals of interest at the output of matrix 411 and, thus, substantially absorbed by component 401 coupled to matrix 411. Of course cross coupling may be present in the distributed amplifier assembly, such as through the use of imperfectly matched matrix components and/or amplifiers, and, therefore, the signal injected by generator 400 may be detectable within other outputs of matrix 411. Accordingly, filters, such as described above, may be utilized to minimize undesired effects of the injected signal. Moreover, out of band rejection of other circuitry, such as may be provided in the aforementioned duplexer circuitry, may be utilized to minimize undesired effects of the injected signal.

Additionally, in a preferred embodiment, where the system of FIG. 4 communicates cellular telephone signals, the frequency of the signal generated by generator 400 is within the 25 MHZ BTS transmit band, although not within the operator's licensed band. Accordingly, in addition to the above techniques for preventing undesired effects of the injected signal, its effects are further mitigated as the injected signal is outside of the spectrum utilized in conducting communications.

In an alternative embodiment, the signal injected by generator 400 is utilized as a pilot to achieve active isolation of the signals amplified by the distributed amplifier assembly. Specifically, a system controller, such a might be deployed as component 402 providing termination of unused outputs of matrix 411, may monitor the generated signal on an output or outputs other than the one upon which it should be present. Information from this controller may be provided to the amplifiers through connections there between (not shown) to adjust and optimize their phase and gain in order to improve the port to port isolation. Likewise, the attributes of the generated signal monitored by a system controller, such as might be deployed as component 401, for use in improving the port to port isolation of the amplifier assembly.

It shall be appreciated that the circuitry of FIG. 4 is desirable, not only due to the fact that use may be made of amplifiers not having internal circuitry in order to assist in the adjustment of internal settings necessary for the linearization of signals to be amplified, but because a single generator is utilized for provision of a pilot signal to each amplifier of the distributed amplifier arrangement, thus resulting in further circuitry simplification and cost effectiveness. Moreover, as it is a generated tone utilized for adjustment of the amplifiers, speed of adjustment of these amplifiers may be improved through the use of pre-defined pilot frequencies. For example, generator 400 may provide the generated signal, or information with respect thereto, to amplifiers 421–436, such as through signal paths coupled there between (not shown), in order that adjustment of these amplifiers need not acquire frequency. Additionally, as desired above, improved port to port isolation may be achieved by monitoring the presence and/or specific attributes, i.e., phase and amplitude, of the injected signal, which is known and therefore easily monitored for specific attributes, and adjusting components within the signal feed path accordingly.

Although described above with reference to a multiple narrow bean antenna system, it shall be appreciated that the present invention is operable with any number of system configurations. For example, the present invention may be coupled to a system providing a more traditional three sectored cellular communication system, such as shown in FIG. 1. Accordingly, the three sector signals may be provided to inputs of a first matrix of the distributed amplifier assembly while an unused input of the matrix is provided the generated signal as described above.

Figure 5:
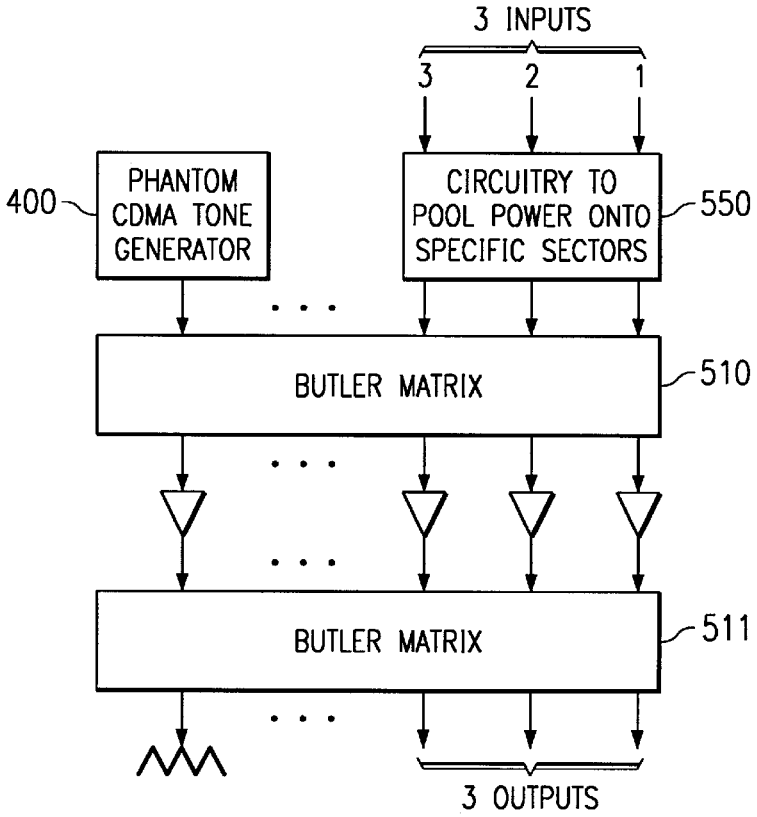
FIG. 5 show circuitry adapted according to an alternative embodiment of the present invention to communicate signals within the sectors of FIG. 1.

Directing attention to FIG. 5, a preferred embodiment of the present invention adapted to operate with a three sectored cellular communication system is shown. The three sector signals, which may be provided by components such as radios 340 and antenna beam coupling matrix 350 of FIG. 3, are input initially into circuitry adapted to pool the amplifiers into a specific sector. Circuitry 550, through providing these sector signals with a proper amplitude and phase relationship to ones of the inputs of matrix 510 is able to "select" the particular amplifiers utilized in the distributed amplification of the signal, i.e., although all amplifiers will be provided with each sector signal, the input amplitude and phase relationship will cause ones of these amplified signals, or portions thereof, to cancel. Therefore, the signal generated by generator 400 is provided to the amplifiers along with the signals of interest as described above with respect to FIG. 4.

Although described above with respect to a 16 by 16 matrix, it shall be appreciated that the present invention is not so limited. Matrices providing any number of input/outputs sufficient to provide the desired amplification of the signals of interest may be used according to the present invention. Moreover, there is no limitation to the use of a matrix having inputs in excess of the number of antenna beam or sector signals communicated. For example, the above example of the three sectored system may utilize a 4 by 4 Butler matrix if desired. Accordingly, in order to provide the generated signal to each of the amplifiers, a combiner, such as a Wilkinson combiner, may be utilized at an input of the matrix in order to simultaneously couple an antenna beam signal or sector signal and the generated signal to each of the outputs of the matrix, and therefore to each of the amplifiers.

Moreover, multiple ones of the aforementioned combiners may be utilized to provide the generated signal to multiple ones of the inputs where desired. For example, where a particular matrix provides only components of the generated signal, which are not suitable for desired operation of the amplifiers, to its outputs, use of multiple combiners may be desired. The above example of the three sectored system may utilize the aforementioned 4 by 4 Butler matrix having a combiner coupled to each of the inputs. Accordingly, one of the three sector signals in combination with the generated signal may be input into each of the matrix inputs for provision to the amplifiers.

Similarly, combiners associated with each antenna beam signal or sector signal to combine the generated signal therewith may be used without the above described amplifier matrix assembly. For example, where the advantages of non-switched redundancy and amplification distributed across an amplifier bank are not desired, the generated signal may be combined with each antenna beam signal prior to its amplification by an amplifier disposed in its signal path in order to provide the proper signal for internal adjustment of the amplifier. Of course, such an arrangement does not provide the advantage of substantial isolation of the injected signal at the output of the amplifier circuitry as discussed above. Instead, this arrangement may rely on the injected signal being out of the band of interest and/or filtering/attenuation techniques as described above where it is desired that the injected signal not be present in the signal of interest as communicated.

Although the present invention and its advantages have been described in detail, it should be understood that various changes, substitutions and alterations can be made herein without departing from the spirit and scope of the invention as defined by the appended claims.

What is claimed is:

1. A system for providing amplification of at least one signal stream using an amplifier which requires signal characteristics not present in the signal stream, said system comprising:

a distributed amplifier assembly disposed in a signal path between a receiving device and a transmitting device, wherein said amplifier assembly includes at least one input for receiving said signal characteristic not present in said signal path, wherein said distributed amplifier includes:

an input matrix, wherein the input matrix provides a number of inputs greater than a number of said at least one signal stream, and wherein said at least one input is an input of said inputs not utilized to provide said at least signal stream to said amplifier bank;

an output matrix, wherein the output matrix provides a number of outputs greater than the number of at least one signal stream, and wherein said provided signal is substantially isolated to an output of said outputs corresponding to said at least one input;

an amplifier bank including said amplifier disposed in signal paths between said input matrix and said output matrix;

a signal source coupled to said at least one input, wherein said signal source is adapted to provide a signal having signal characteristics required by said amplifier and introduces said generated signal into said at least one input; and a controller coupled to at least one output of said outputs not utilized to communicate said at least one signal stream between said receiving device and said transmitting device, wherein said controller is adapted to monitor an attribute of said provided signal at said at least one output and to provide a control signal to amplifiers of said amplifier bank for optimization of port to port isolation of said amplifier assembly.

2. The system of claim 1, wherein said input matrix is a 16 by 16 matrix and said output matrix is a 16 by 16 matrix and said amplifier bank includes 16 amplifiers.

3. The system of claim 2, wherein said at least one signal stream includes a plurality of discrete antenna beam signals each coupled to a discrete input of said 16 by 16 input matrix.

4. The system of claim 3, wherein said plurality of discrete antenna beam signals is 12 antenna beam signals associated with 12 narrow antenna beams.

5. The system of claim 3, wherein said plurality of discrete antenna beam signals is 3 antenna beam signals associated with 3 sectors of a cell.

6. The system of claim 1, wherein each of said input matrix and said output matrix is selected from the group consisting of:

a hybrid matrix; and a Butler matrix.

7. The system of claim 1, wherein said at least one input is associated with a combiner disposed to combine a signal stream of said at least one signal stream with said provided signal.

8. The system of claim 1, wherein said amplifier is a linear power amplifier having no internal circuitry for providing a pilot signal for linear operation of the amplifier and relying on signals provided externally thereto for internal adjustment for linear operation, and wherein said provided signal is specifically generated to provide a signal for use by said amplifier.

9. The system of claim 8, wherein said signal source includes apparatus for generating a signal which includes an emulated CDMA carrier.

10. The system of claim 8, wherein said provided signal includes an emulated CDMA carrier.

11. The system of claim 10, wherein said CDMA carrier is an IS-95 CDMA carrier.

12. The system of claim 10, wherein said at least one signal stream includes a cellular communication signal other than a CDMA carrier.

13. The system of claim 12, wherein said cellular communication signal is selected from the group consisting of:

AMPS;

N-AMPS;

GSM;

PCS;

IS-136; and

TDMA.

14. The system of claim 1, wherein said receiving device includes a radio unit and said transmitting device includes an antenna array.

15. The system of claim 1, wherein said receiving device includes an antenna array and said transmitting device includes a radio unit.

16. A system for providing manipulation of a plurality of discrete signal streams when the signal streams do not have a particular signal characteristic, said system comprising:

means for manipulating an attribute of each signal stream of said plurality of signal streams, wherein said manipulating means is operable to manipulate signals in a desired manner only upon the presence of a signal having said particular signal characteristic; and means for providing said signal characteristics to at least one input of said manipulating means, wherein said signal characteristics are provided by an emulated IS-95 CDMA carrier.

17. The system of claim 16, wherein said at least one input is an input of said manipulating means not used by said plurality of signals.

18. The system of claim 16, wherein said manipulating means comprises a distributed amplifier.

19. The system of claim 18, wherein said distributed amplifier includes a plurality of linear power amplifiers having no internal circuitry for providing a pilot signal for linear operation of the amplifier.

20. The system of claim 19, wherein said emulated IS-95 CDMA carrier provided by said providing means is adapted for use by each of said plurality of amplifiers.

21. The system of claim 20, wherein information with respect to said emulated IS-95 CDMA carrier is provided to each amplifier of said plurality of amplifiers for use by said amplifiers in improved linear operation.

22. The system of claim 16, wherein said manipulating means comprises:

an input matrix providing said number of inputs greater than the total number of said signal streams of said plurality of signal streams and a number of outputs equal to said number of inputs;

an output matrix providing a number of inputs and a number of outputs equal to the number of inputs and outputs of said input matrix, wherein a signal path is provided between each output of said input matrix and a corresponding input of said output matrix; and a plurality of signal manipulation devices, wherein at least one signal manipulation device is coupled in each said signal path between the outputs of said input matrix and inputs of said output matrix.

23. The system of claim 22, wherein a signal provided to any one of said inputs of said input matrix is provided at least in part to each output of said input matrix.

24. The system of claim 23, wherein said emulated IS-95 CDMA carrier is substantially isolated to an output of said output matrix corresponding to said at least one input.

25. The system of claim 24, further comprising:

means for monitoring said emulated IS-95 CDMA carrier coupled to at least one output of said output matrix; and means coupled to said monitoring means for controlling said manipulating means in response to monitoring of said emulated IS-95 CDMA carrier.

26. The system of claim 25, wherein said controlling means provides optimization of isolation of signals associated with said outputs of said output matrix.

27. The system of claim 16, wherein said emulated IS-95 CDMA carrier is outside a band of the signals of said plurality of discrete signal streams.

28. A method for providing manipulation of a plurality of signals of interest not having a desired signal characteristic, said method comprising the steps of:

generating a signal having said desired signal characteristic;

combining said generated signal with said signals of interest thereby providing a plurality of combined signals;

manipulating an attribute of each said combined signals thereby producing manipulated combined signals;

utilizing said desired signal characteristic of said generated signal in the operation of said manipulating step;

isolating said generated signal from said manipulated combined signals;

monitoring said generated signal after manipulation of said combined signals at said manipulating step; and controlling said manipulating step in response to monitoring of said generated signal.

29. The system of claim 28, wherein said combining step utilizes an N input by N output first matrix, wherein a signal input at any one of said N inputs is provided at least in part at each of said N outputs.

30. The system of claim 29, wherein N is a number larger than the number of said plurality of signals of interest, and further comprising the step of:

coupling said generated signal to an input of said first matrix not utilized for input of said plurality of signals of interest for said combining with said plurality of signals of interest.

31. The system of claim 30, wherein said isolating step utilizes an M input by M output second matrix, wherein a signal provided in a proper phase and amplitude relationship to ones of said M inputs will substantially only be provided at one of said M outputs.

32. The system of claim 31, wherein N and M are equal.

33. The system of claim 31, wherein a plurality of signal manipulation devices are disposed in signal paths coupling each of said N outputs with a corresponding one of said M inputs.

34. The system of claim 33, further comprising the step of:

adjusting internal settings of ones of said signal manipulation devices utilizing said desired characteristic of said generated signal.

35. The system of claim 34, wherein said signal manipulation devices are linear power amplifiers and said internal settings adjusted in said adjusting step are settings necessary for the linearization of amplified signals.

36. A system for providing amplification of a plurality of discrete signal streams not having an advantageous signal characteristic, said system comprising:

a first matrix having a plurality of inputs and a plurality of outputs, wherein the number of inputs of said plurality of inputs is larger than the number of discrete signal streams of said plurality of signal streams, and wherein ones of said inputs of said first matrix are coupled to at least one of said signal streams and other ones of said inputs of said first matrix are not coupled to said signal streams;

a second matrix having a plurality of inputs and a plurality of outputs, wherein a plurality of signal paths couple each said input of said second matrix to at least one output of said first matrix;

a plurality of amplifiers, wherein at least one amplifier is disposed in each signal path of said plurality of signal paths, wherein said amplifiers are operable to amplify signals only upon the presence of a signal having said advantageous signal characteristic; and a signal generator coupled to at least one of said other ones of said inputs of said first matrix, wherein said signal generator provides a generated signal having said advantageous signal characteristic to said first matrix, and wherein said generated signal is an emulated IS-95 CDMA signal.

37. The system of claim 36, wherein each of said first and said second matrices are a Butler matrix.

38. The system of claim 36, wherein each of said first and said second matrices are a hybrid matrix.

39. The system of claim 36, wherein said advantageous characteristic is a broadband signal characteristic.

40. The system of claim 39, wherein said generated signal has a controlled rectangular spectral shape.

41. The system of claim 36, wherein said amplifiers are feed forward linear power amplifiers.

42. The system of claim 36, further comprising:

a filter disposed in signal paths associated with each discrete signals stream of said plurality of discrete signal streams after said signals are amplified by said amplifiers, wherein said filter is adapted to reject at least a portion of said generated signal.

43. The system of claim 36, further comprising:

a controller coupled to at least one of said outputs of said second matrix and coupled to ones of said amplifiers, wherein said controller monitors attributes of said generated signal at said outputs coupled to said controller and provides information to said amplifiers coupled to said controller to alter their operation accordingly.

44. The system of claim 36, wherein ones of said amplifiers include information with respect to said generated signal.

45. The system of claim 44, wherein said information is utilized by said amplifiers to acquire said generated signal for amplification of said signal streams.

* * * * *